United States Patent [19]

Voye, Jr.

[11] Patent Number: 4,656,856

[45] Date of Patent: Apr. 14, 1987

[54] METHOD AND APPARATUS FOR ELIMINATING CRESCENT FORMATION IN A REDUCTION MILL

[75] Inventor: Joseph L. Voye, Jr., Portage, Ind.

[73] Assignee: Bethlehem Steel Corporation, Bethlehem, Pa.

[21] Appl. No.: 790,536

[22] Filed: Oct. 23, 1985

[51] Int. Cl.[4] ..... B21B 37/06

[52] U.S. Cl. ..... 72/11; 72/14; 72/17; 72/205; 72/234

[58] Field of Search ..... 72/14, 15, 17, 11, 205, 72/234

[56] References Cited

U.S. PATENT DOCUMENTS 4,162,624 7/1979 Morooka et al. ..... 72/17 X

*Primary Examiner*—Robert L. Spruill
*Assistant Examiner*—Steve Katz
*Attorney, Agent, or Firm*—Shlesinger, Arkwright, Garvey & Fado

[57] ABSTRACT

The apparatus and method for eliminating crescent formation in a steel strip reduction mill includes a strip tension monitor which measures the tension between the stands and transmits the measured tension to a controller. A roll speed monitor for the driven roll of the stands transmits data to the controller indicative of the roll speed. A tail end detector is positioned upstream of the upstream stand for detecting the tail end of the strip and for transmitting that information to the controller. A controller receives the data and calculates a target interstand strip tension when the tail end is sensed and causes a speed controller to increase the rotational speed of the rolls and to thereby decrease the strip tension until such time as the measured tension equals the target interstand tension.

26 Claims, 3 Drawing Figures

METHOD AND APPARATUS FOR ELIMINATING CRESCENT FORMATION IN A REDUCTION MILL

BACKGROUND OF THE INVENTION

The preparation of steel strip requires the reduction in gauge of a relatively large and thick steel form by means of passing this form through a reduction mill. During the course of reduction in the mill, the steel is passed between a plurality of driven rollers which are spaced apart a predetermined distance which is less then the thickness of the steel. Each subsequent set of rollers has a thinner gap so that the steel is progressively reduced from the initial thickness to the final desired thickness.

The driven rolls of each stand of the reduction mill not only reduce the thickness of the steel but also pull the steel therebetween. Normally, the stands are set-up in tandem whereby a first stand feeds the strip to the rollers of the next subsequent stand. In this way, the steel may be considered to have been stretched by the cooperative action of the reducing rolls of the tandem pair of stands. This stretching has the undesirable effect, however, of causing the tail end of the strip to be extruded from between the rolls. The extrusion effect is believed, by applicant, to be caused by the pulling of the end of the strip through the rolls rather than it being rolled through.

Applicant believes that the extrusion of the tail end causes small slivers of steel to be formed which break off from the now sharpened tail end of the strip during subsequent rolling in the mill. These steel slivers are usually curved and are capable of scoring or otherwise permanently denting or marking the work rolls. Marking of the work rolls causes the crescent form of the slivers to be repetitively marked onto the coils during the continued rolling operation.

Crescent formation of the finished strip product is undesirable because it is normally a surface defect which requires that the strip either be rerolled to remove it or else be downgraded. Marking of the work rolls by the slivers requires that the rolls be changed or else, naturally, the next subsequent coil will likewise be marked. Those skilled in the art realize that roll changes are expensive, not only because of the cost of the rolls but also because of the downtime required for their changing.

During the rolling operation in the tandem mill, the strip is subjected to high levels of tension because of the cooperative relationship between the rolls of the stands. The tension of the strip between the stands is a function of the differences in the rotational speed between the stands, among other things. Reduction of this tension prior to passage of the tail end through the rolls of a stand has been found to be an effective means of preventing crescent formation. Because of the decreased tension, the tail end is not stretched and therefore not extruded but is, instead, rolled through the stand. The tiny slivers associated with the extrusion of the tail end are therefore avoided and, hence, the work rolls are not gouged.

OBJECTS AND SUMMARY OF THE INVENTION

The primary object of the disclosed invention is to provide an apparatus and method for regulating interstand strip tension between the associated stands of a tandem mill so that crescent formation is avoided. Tension regulation occurs because the roll speed at the upstream stand is increased and the tension therefore decreased so that the strip is rolled through the stand rather then being pulled through.

The disclosed apparatus includes strip tension monitors between the cooperating stands for monitoring the running tension of the strip between the stands and for transmitting data indicative of the strip tension to a central control processor. Each driven roll of a stand has a diameter compensated speed monitor which monitors the rotational speed of the roll and which transmits to the processor information concerning the roll speed. Each of the stands has a tail end detector for detecting the presence of the tail end of a strip and for transmitting that information to the processor so that the tension of the downstream tandem pairs can be appropriately adjusted. The driven roll of each stand has a speed controller connected to the processor. In this way, the processor can cause the roll speed to be adjusted so that a calculated minimal target strip tension will be achieved. The processor causes the roll speed to increase by generating a speed bias signal while simultaneously monitoring the strip tension and adjusting the bias signal until the measured tension equals the calculated tension. When the desired strip tension is achieved, then the speed bias applied to the speed controllers is at zero because the bias signal is proportional to the difference between the measured tension and the target tension, so that the tension does not decrease below the determined level. This avoids the possibility of a mill wreck and also prevents the strip from walking on the rolls transverse to the rolls, as can happen when the tension is not high enough.

Typically, a tandem reduction mill will have at least four reducing stands, as well as a fifth take-up roll. The normal operating tension of the tandem pairs tyically decreases from the upstream tandem pairs to the downstream tandem pairs. Therefore, the target interstand tension must also be altered from one tandem pair to the next. Applicant has discovered that the target interstand tension is best determined as a percentage of the instantaneous strip tension at the time the tail end is detected. A fixed level of tension is not normally desired because the control processor operates at such high speeds that a fixed target is difficult to attain, particularly when each strip is operated on at a specific tension level related to the product desired.

In summary, the disclosed method and apparatus involves a dynamic system for regulating the interstand strip tension in a tandem reduction mill to avoid the formation of slivers at the tail end which can mar the work rolls and thereby cause crescents to be formed on the strip. The system is dynamic because it utilizes the instantaneous interstand strip tension at the time the tail end is detected and derives a target tension which is a selected percentage of the instantaneous tension. The central processor regulates the roll speed while monitoring the strip tension and thereby assures proper speed of the rolls. The system operates in a cascade fashion from one tandem pair to the next as the tail end progresses through the stands of the mill.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
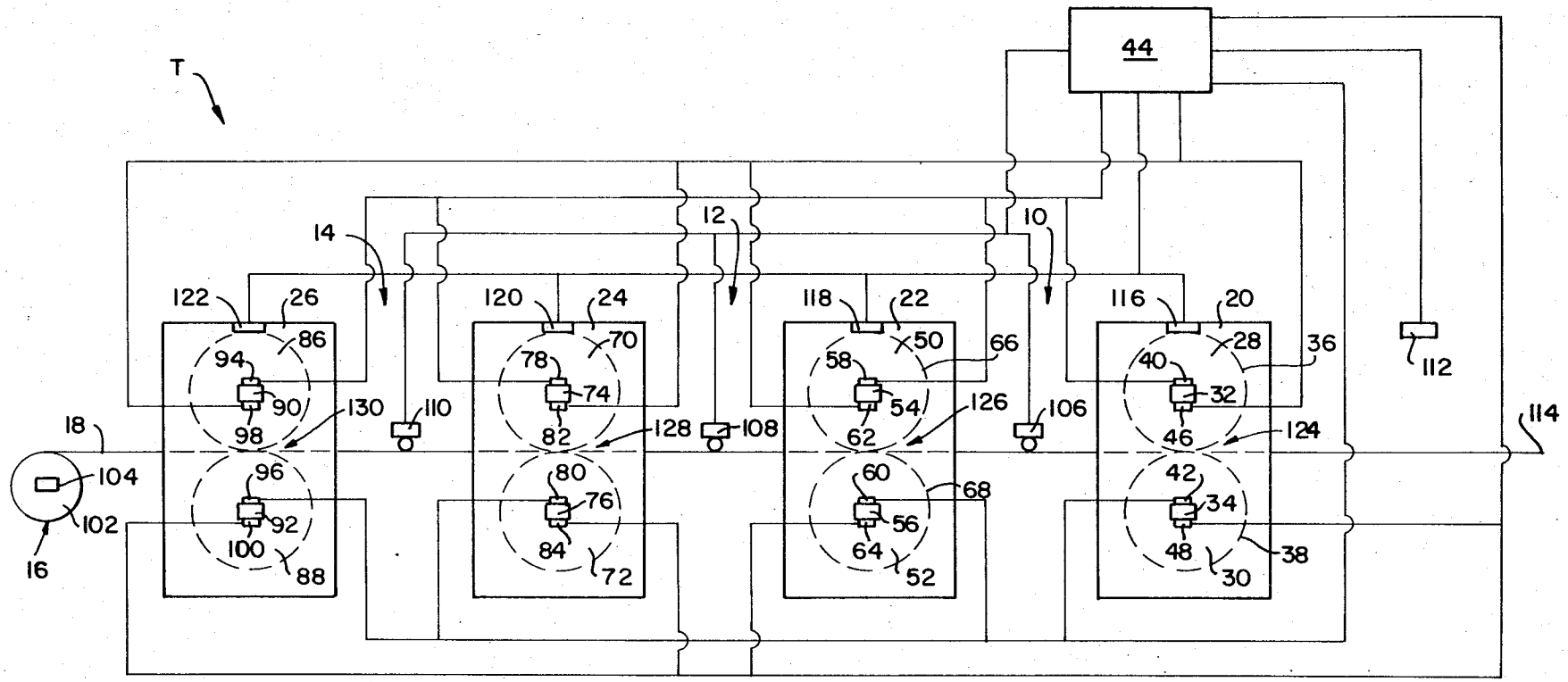
FIG. 1 is a side elevational view of a tandem mill with portions shown in phantom and with portions of the control system shown in schematic form.

As best shown in FIG. 1, tandem mill T has first, second and third aligned tandem pairs 10, 12 and 14, respectively, and coiler 16 on which steel strip 18 is coiled after the desired reduction has been accomplished. Tandem pair 10 comprises roll stands 20 and 22, while tandem pair 12 comprises roll stands 22 and 24 and tandem pair 14 comprises roll stands 24 and 26. The roll stands 20, 22, 24 and 26 are longitudinally aligned, as is well known in the art, and are disposed in spaced relation with each stand, preferably, about 15 feet from its immediately upstream and immediately downstream stands.

Stand 20 supports cylindrical work rolls 28 and 30 which have their axes disposed in spaced parallel relation and which work rolls are driven or rotated on their respective axes by motors 32 and 34, respectively. The outer surfaces 36 and 38 of work rolls 28 and 30 are spaced apart a preselected distance and it is through the gap thereof that the strip 18 passes while being reduced. Work rolls 28 and 30 have roll speed monitors 40 and 42, respectively, which monitor the rotational speed of the respective rolls on their axes and which transmit information indicative of the respective roll speeds to central controller or processor 44. Processor 44 preferably includes a microcomputer or similar modern control device.

Work rolls 28 and 30 have roll speed controllers or regulators 46 and 48, respectively, which are connected to the controller 44 and the associated work roll motors 32 and 34, respectively. Regulators 46 and 48 regulate the rotational speed of the associated work roll in response to the speed bias signal transmitted by the controller 44. In this way, the controller 44 can adjust and control the rotational speed of each of the work rolls 28 and 30, respectively, in order to achieve a desired decrease or increase in the tension of strip 18.

Stand 22 likewise has work rolls 50 and 52; each of the work rolls 50 and 52 having an associated motor 54 and 56, respectively. As described for stand 20, each of the rolls 50 and 52 has roll speed monitors 58 and 60, respectively, as well as speed regulators 62 and 64, respectively. The gap between the roll surfaces 66 and 68 of the rolls 50 and 52, respectively, is less than is the associated gap between the surfaces 36 and 38 of rolls 28 and 30, respectively, so that the strip 18 has the thickness thereof reduced incrementally in a cascade fashion, as is known to those skilled in the art.

Stand 24 has work rolls 70 and 72, with driving motors 74 and 76, respectively, and roll speed monitors 78 and 80, respectively. The roll speed monitors are in circuit connection with controller 44 and transmit data thereby indicative of the speeds of the rolls 70 and 72. Similarly, speed regulators 82 and 84 cooperate with the respective motors 74 and 76 and regulate and control the rotational speed of rolls 70 and 72 in response to the speed bias signal of controller 44.

Stand 26 has rolls 86 and 88 disposed in spaced parallel relation and each of the rolls 86 and 88 has a motor 90 and 92, respectively, for driving the associated roll on its axis. Roll speed monitors 94 and 96 transmit data indicative of the roll speed to central processor 44. Processor 44 calculates a speed bias at the appropriate time, which bias signal is transmitted to roll speed controllers 98 and 100 so that the rolls 86 and 88 rotate on their respective axes at a desired speed.

Coiler 16 has a removable mandrel 102 which is rotated by motor 104 so that the strip 18 will be wound about the mandrel 102 after passing through tandem mill T and having achieved the desired gauge. Those skilled in the art will appreciate that the strip 18 has substantial thickness prior to passing through the gap between rolls 28 and 30 and that this thickness is progressively decreased as the strip 18 passes through the rolls of the downstream stands 22, 24 and 26. The peripheral surfaces of the rolls of the stands 22, 24 and 26 define progressively narrower gaps, the last of which results in the strip 18 having its desired thickness. Those skilled in the art will also realize that tandem mill T may have a fewer or greater number of stands, depending upon the mill and the type of products being produced.

Analog tensiometers 106, 108 and 110 are appropriately positioned between the stands of respective tandem pairs 10, 12 and 14. The tensiometers 106, 108 and 110 each includes a tensiometer roll which is positioned at a precise location between the associated stands 20, 22, 24 and 26. The tensiometers are calibrated so that a vertical load caused by the strip 18 pressing upon the roll causes an electronic load cell to generate an electrical signal proportional to the total pounds of force exerted by the strip 18 on the tensiometer. The analog signals from the tensiometer 106, 108 and 110 are transmitted to the processor 44 so that the processor 44 can monitor the strip tension between the associated stands.

The strip 18 moves at a relatively rapid rate of speed through the tandem mill T. Because of the speed of the strip it is necessary that a detector be placed upstream of each of the stands so that the presence of the tail end of the strip can be noted with sufficient time to permit the controller 44 to react thereto and to appropriately bias the relevant one of the speed controllers 46 and 48, 62 and 64, 82 and 84 and 98 and 100.

Initially, the strip 18 is in a heated condition prior to entering the tandem mill T. An infrared sensor 112 is positioned a preselected distance, preferably about 15 feet, upstream of stand 20 and above strip 18. The sensor 112 monitors the strip temperature as indicated by infrared radiation and in this way the presence of the tail end 114 of the strip 18 can be detected because appreciable infrared radiation, if any, will no longer be observed. In other words, the strip 18 emits infrared radiation which is detected by the sensor 112 during its passage thereunder and the tail end 114 is detected because after the tail end 114 there is no longer sufficient infrared radiation for detection by sensor 112. Therefore, the absence of infrared radiation at sensor 112 indicates that the tail end 114 has passed. The sensor 112 is connected to the processor 44 so that appropriate operations which will be hereinafter explained can be effectuated.

From the above, it can be appreciated that each of tandem pairs 12 and 14 likewise requires a tail end detector in order to give the upstream stands thereof, 22 and 24, sufficient time in which to satisfactorily regulate the roll speed of the associated rolls. For this reason, press ductors 116, 118 and 120 are provided for stands 20, 22 and 24. Also, when preferred, a press ductor 122 can be provided for stand 26. The press ductors 116, 118, 120 and 122 are analog devices which measure the force exerted on the associated work rolls by passage of the strip 18 through the work roll gaps 124, 126, 128 and 130. As previously explained, it is passage of the strip 18 through the gaps 124, 126, 128 and 130 which causes the thickness of the strip 18 to be reduced. Because the strip 18 has a thickness exceeding the gap height prior to passage therethrough, the strip 18 exerts a measurable force on the rolls of the stands 20, 22, 24 and 26. Monitoring of the force exerted by the strip 18 on the rolls when in the gaps therefore permits the presence of a strip to be detected and, similarly, the absence of strip after passage of the tail end 114. Therefore, after passage of the tail end 114 through any one of the gaps 124, 126, 128 and 130, the processor 44 will receive data from the respective press ductors 116, 118, 120 and 122 indicative of the passage therethrough of the tail end 114. Once the processor 44 receives the data indicative of the passage of the tail end 114, then the necessary speed regulation for the immediately downstream tandem pair 12 or 14 can be initiated in sufficient time to permit proper adjustment of the roll speed.

Figure 3:
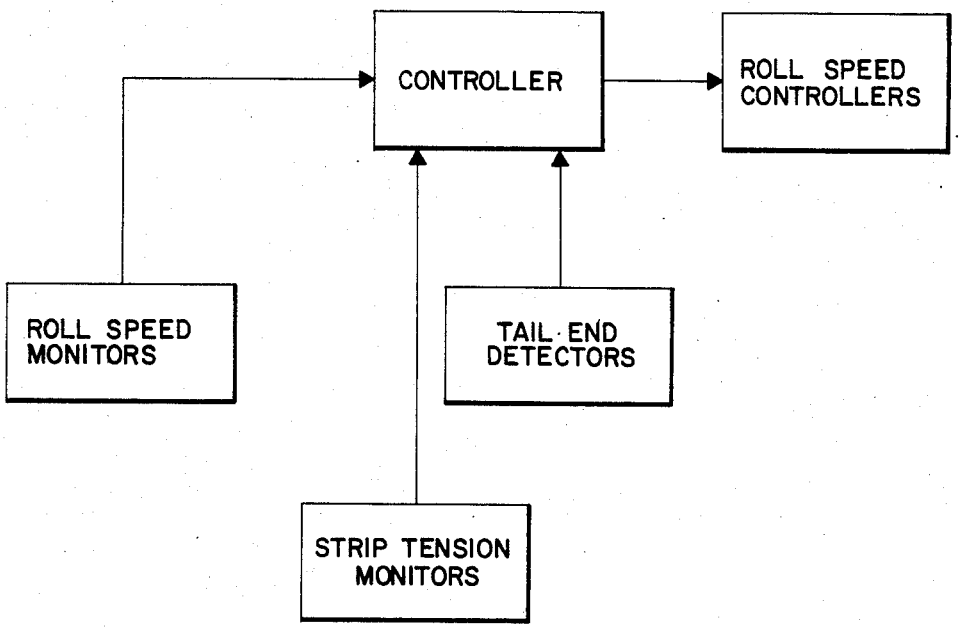
FIG. 3 is a block diagram of the control system of the invention.

FIG. 3 illustrates the various inputs and outputs of the controller 44 which are employed to regulate the interstand tension and the roll speed so that crescents are avoided. Each of the analog roll speed monitors transmits data to the controller 44. The controller 44 periodically samples the incoming data in order to monitor the operation of tandem mill T. Preferably, controller 44 updates the data approximately every 10 milliseconds. The tail end detectors, which includes the infrared sensor 112 and the press ductors 116, 118, and 120, communicate with the controller 44 for supplying the related data thereto. Similarly, the strip tension monitors 106, 108 and 110 transmit data to the controller 44 which is periodically sampled during operation of tandem mill T. When tail end 114 of the strip 18 is sensed, for example by infrared sensor 112, then the controller 44 immediately updates the information concerning the roll speed of rolls 28 and 30 and 50 and 52, while also reading the tension indicated by tensiometer 106. The controller 44 next calculates a speed bias which is transmitted to controllers 46 and 48 and causes the associated rolls 28 and 30 to increase their rotational speed and thereby decrease the interstand tension for tandem pair 10. The roll speed continues to increase until the tension measured by tensiometer 106 equals the calcualted target interstand tension. Controller 44 calculates the target interstand tension as a percentage of the measured tension at the instant the infrared detector 112 sensed the tail end 114. Once the target interstand tension is achieved, then the speed bias is at a zero value and the strip continues to roll out at that nominal tension. Those skilled in the art will realize that the speed bias signal is proportional to the difference between the measured tension and the target tension. Therefore, the speed bias signal decreases as this difference decreses.

Figure 2:
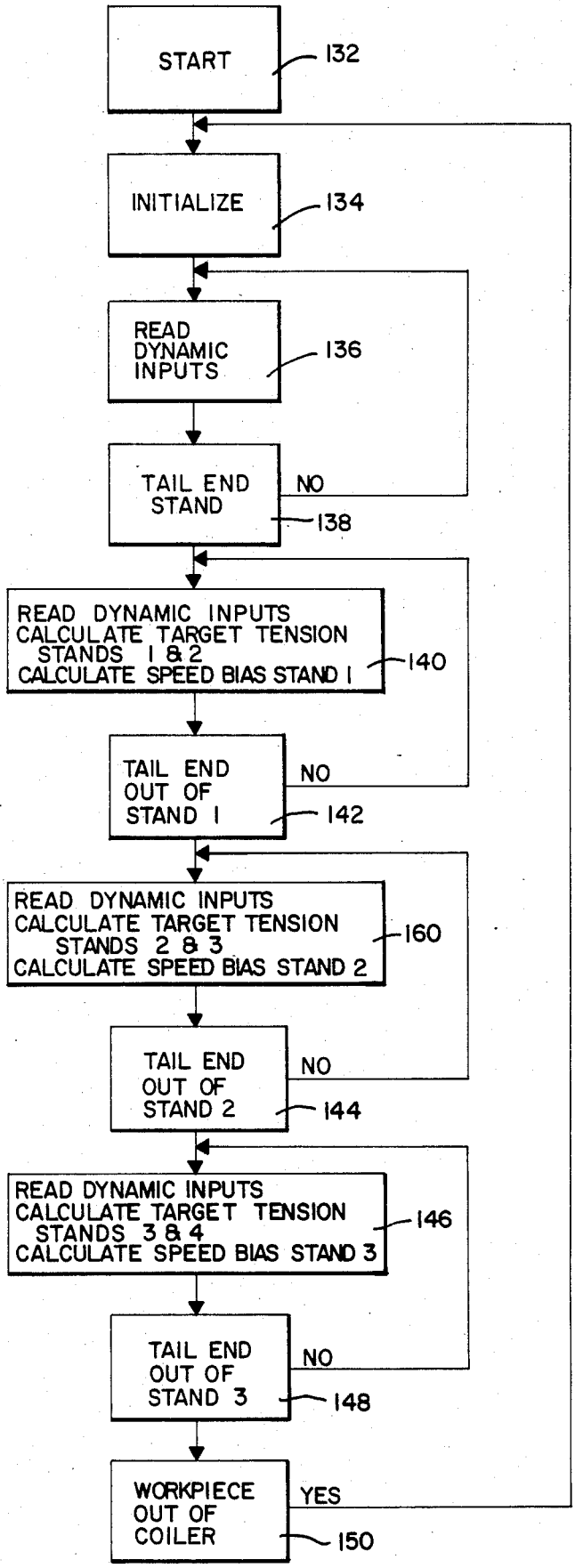
FIG. 2 is a flow chart of the algorithm utilized by the system.

FIG. 2 illustrates the algorithm on which the processor 44 operates to regulate the interstand tension. Preferably, a manual start button is provided for initially powering the system when the tandem mill T first begins operation. Start 132 causes the system to be energized with the result that the system signals are inputted to the controller 44 during the initialization stage 134. The initialization stage 134 includes appropriate input of the percentage values used to calculate the target interstand tension. Next, the algorithm at 136 reads the system dynamic inputs, which includes the signal from infrared sensor 112, the analog signals from tensiometers 106, 108 and 110, the speed signals from roll speed monitors 40 and 42, 58 and 60, 78 and 80, and 94 and 100 and also the signals generated by press ductors 116, 118 and 120. As previously indicated, the dynamic signals are periodically updated and the system next inquires at 138 whether the tail end has been sensed by any of the tail end detectors 112, 116, 118 and 120. If no, then the dynamic inputs continue to be read at 136. If a tail end is sensed by infrared sensor 112, for example, then the controller 44 immediately reads the dynamic inputs, computes the target interstand tension for the strip between stands 20 and 22, calculates the speed bias for controllers 46 and 48 and then checks to see if the built-in limits for speed and bias have been exceeded. Due to the nature of the rolling operation, the processor 44 has certain built in limitations which prevent the rolls from exceeding certain speed levels which could cause the associated motors to exceed their design limits.

After the dynamic inputs have been read at 140, then the speed bias signal is transmitted to the regulators 46 and 48 while the controller 44 monitors the tension measured by tensiometer 106 and compares the measured tension to the calculated target tension. The algorithm at 142 then makes inquiry of press ductor 116 of whether the tail end 114 is out of stand number 20. If it is not out of stand number 20, then the dynamic inputs are again read and compared with the target interstand tension and the speed bias signal adjusted. If the tail end 114 is out of stand number 20, then the algorithm proceeds to 160, otherwise the algorithm continues to cycle.

Step 160 is similar to step 140 in again requiring that the dynamic system inputs be read, that a target tension for tandem pair 12 be calculated and a speed bias signal be derived and transmitted to controllers 62 and 64. The algorithm then asks at 144 whether the tail end 114 is out of stand 22. If it is not out of stand 22, then the dynamic inputs are again read and the target tension is compared with the measured tension and the speed bias adjusted accordingly. If the tail end 114 is out of stand 22 then similar steps then begin for tandem pair 14.

The algorithm at 146 reads the dynamic inputs related to operation of tandem pair 14 and again calculates a target interstand tension and a speed bias signal which is transmitted to the controllers 82 and 84. The algorithm inquires of press ductor 120 whether the tail end 114 is out of stand 24 at 148. If it is not out of stand 24, then the dynamic inputs are again read and the measured tension compared with the target calculated tension and appropriate adjustments made to the calculated speed bias. If the tail end 114 is out of stand 148, then the algorithm asks at 150 if the strip 18, which has been coiled around mandrel 102 is out of the coiler 16. If it is, then the algorithm returns to the initialization stage 134.

Those skilled in the art will realize that derivation of the speed bias signals by controller 44 is based upon empirical analysis of tandem mill T, as well as knowledge of the roll size, product thickness, etc. An increase in roll speed of upstream rolls will increase the downstream strip tension, however.

OPERATION

Operation of the method and apparatus described herein is relatively simple and is automatic once the controller 44 and the tandem mill T have begun operation. The tandem mill T naturally includes appropriate controls (not shown) for controlling the mill T while the strip 18 is being rolled. Once the infrared sensor 112 senses the tail end 114, then the processor 44 immediately calculates a target interstand tension level which is a percentage of the instantaneous strip tension of tandem pair 10 measured by tensiometer 106 at the time the sensor 112 senses the tail end 114. Applicant has discovered that the target interstand tension for tandem pair 10 should be about 10 percent of the measured interstand tension. The controller 44 therefore causes the controllers 46 and 48 to increase the rotational speed of rolls 28 and 30 after the target interstand tension has been calculated and to continue to increase this speed until the measured tension equals the target interstand tension. Those skilled in the art will appreciate that as the measured tension approaches the target interstand tension, the speed bias signal will be incrementally decreased so that when the measured tension equals the target tension, the speed bias will be at zero. Because of the speed of the controller 44, a zero speed bias will be achieved prior to passage of the tail end 114 through the rolls 28 and 30 so that the formation of the slivers which have been found to break off will be avoided.

The controller 44 monitors the signal of press ductor 116 as a means of following or tracking the strip 18 through stand 20. When the press ductor 116 indicates that the tail end 114 has passed through the rolls 28 and 30, then the processor 44 instantaneously measures the roll speed of rolls 50 and 52 and reads the interstand tension measured by tensiometer 108. Typically, the normal operating interstand tension for tandem pair 12 will be less than the interstand tension for tandem pair 10 and, therefore, the percentage value used to calculate the target tension for tandem pair 12 is preferably 50 percent of the instantaneous measured tension rather then the 10 percent used with tandem pair 10. Again, the controller 44 causes the controllers 62 and 64 to speed up the rolls 50 and 52, respectively, until such time as the speed bias signal again achieves a zero value and thereby indicates that the tension measured by tensiometer 108 equals the calculated target tension.

Once the press ductor 118 senses passage of the tail end 114 through the rolls 50 and 52, then the processor 44 instantaneously measures the roll speed of the rolls 70 and 72 and reads the tension measured by tensiometer 110. This time, the target interstand tension is set to be 70 percent of the measured tension. The processor 44 generates the speed bias signal for the controllers 82 and 84 and causes the speed of the rolls to increase, and thereby the tension to decrease, until such time as the measured tension equals the target interstand tension. At this point, the speed bias signal is zero and the rolls 70 and 72 continue to rotate at that speed. Once the press ductor 120 indicates that the tail end 114 has passed between the rolls 70 and 72, then the next inquiry is whether the strip 18 has been removed from the coiler 16. If yes, then the system is initialized and the next strip may be rolled.

Those skilled in the art will appreciate from the above that the described invention permits precise control over the interstand tension by means of appropriate regulation of the speed of the upstream rolls. While applicant has described percentage values used in calculating the target interstand tension, those skilled in the art will appreciate that these percentage values may be varied depending upon the mill on which the strip 18 is being run. Furthermore, these percentage values may be varied depending upon the product which is being run, particularly thin width products which normally are reduced at much lower strip tensions. Nevertheless, the apparatus and method of the invention permits the mill operator to have automatic control over the rolling of the tail end 114 sufficient to avoid crescent formation.

While this invention has been described as having a preferred design, it is understood that it is capable of further modifications, uses and/or adaptations of the invention following in general the principle of the invention and including such departures from the present disclosure has come within known or customary practice in the art to which the invention pertains, and as may be applied to the central features hereinbefore set forth, and fall within the scope of the invention of the limits of the appended claims.

What I claim is:

1. Apparatus for regulating interstand strip tension to avoid crescent formation in a reduction mill having an upstream stand and a downstream stand, each of said stands having a driven roll, comprising:

(a) strip tension monitoring means between said stands for engagement with a strip when the strip is between said stands for monitoring the tension of the strip when between said stands and for transmitting data indicative thereof;

(b) roll speed monitoring means for connection with at least the driven roll of said upstream stand for monitoring the rotational speed of the roll and for transmitting data indicative thereof;

(c) speed control means for connection with the driven roll of said upstream stand for regulating the rotational speed thereof;

(d) tail end detection means for being positioned upstream of and proximate the upstream stand for detecting the tail end of a strip and for transmitting data indicative thereof when detected; and, (e) a controller in circuit connection with said strip tension monitoring means, said roll speed monitoring means and said tail end detection means for receiving the data transmitted therefrom and said controller including means for calculating a target interstand tension sufficiently below the last monitored tension to prevent extrusion of the strip upon detection of the tail end of the strip and said controller in circuit connection with said speed control means and including means responsive to the data of said strip tension monitoring means for causing the speed of the driven roll of the upstream stand to be increased sufficiently so that the calculated target interstand tension is attained prior to the passage of the tail end therethrough.

2. The apparatus of claim 1, wherein:

(a) said tail end detection means including an infrared sensor.

3. The apparatus of claim 1, further comprising:

(a) first detecting means being positioned proxiate said upstream stand for detecting passage of a tail end therethrough.

4. The apparatus of claim 3, wherein:

(a) said first detecting means including pressure sensing means associated with said upstream stand for monitoring changes in the pressure exerted on the driven roll; and, (b) said first detecting means being operably associated with said controller.

5. The apparatus of claim 4, wherein:

(a) said first detecting means including a press ductor.

6. The apparatus of claim 1, further comprising:

(a) second detecting means associated with said upstream stand for detecting when a strip is in said upstream stand.

7. The apparatus of claim 6, wherein:

(a) said second detecting means including force responsive means associated with said upstream stand for monitoring changes in the pressure exerted on the driven roll by the strip; and, (b) said second detecting means being in circuit connection with said controller for transmitting data thereto indicative of a strip being in said upstream stand.

8. The apparatus of claim 1, wherein:

(a) a motor being operably-connected with said driven rolls of said stands for rotating said rolls.

9. The apparatus of claim 1, wherein:

(a) each of said stands having first and second driven rolls;

(b) said roll speed monitoring means for independently monitoring the rotational speed of each driven roll of a stand; and, (c) said speed control means being operably associated with said upstream stand driven rolls for regulating the speeds thereof.

10. The apparatus of claim 1, wherein said mill including:

(a) first, second, third and fourth spaced apart stands, each of said stands including at least one driven roll;

(b) said strip tension monitoring means monitoring the tension between tandem pairs of said stands comprising said first and second stands, said second and third stands and said third and fourth stands;

(c) said roll speed monitoring means monitoring the rotational speed of the driven roll of each of said stands;

(d) said speed control means regulating the roll speed of the driven roll of each of said stands; and, (e) third detecting means being associated with said first, second and third stands for detecting when the tail end of a strip has passed through the associated stand, said third detecting means being in circuit connection with said controller so that said controller calculates a target interstand tension for the immediately subsequent one of said tandem pairs after passage of the tail end through the immediately preceding tandem pair and said speed control means regulates the roll speed of the driven roll of the upstream stand of said subsequent tandem pair for attaining said target interstand tension.

11. The apparatus of claim 10, wherein:

(a) said strip tension monitoring means including means being positioned between the stands of each of said tandem pairs of stands.

12. The apparatus of claim 10, wherein:

(a) said tail end detection means being positioned upstream of said first stand.

13. The apparatus of claim 10, wherein:

(a) said roll speed monitoring means including means associated with the driven roll of each of said stands whereby the roll speeds are independently monitored.

14. The apparatus of claim 10, wherein:

(a) said speed control means including means associated with the driven roll of each of said stands whereby the roll speeds are independently regulated.

15. The apparatus of claim 10, wherein:

(a) each of said stands including a first and a second driven roll, said driven rolls being adjacently disposed so that the strip passes therebetween and is thereby reduced.

16. The apparatus of claim 15, wherein:

(a) said roll speed monitoring means for monitoring the rotational speed of each driven roll of each of said stands; and, (b) said speed control means being connected with each of said driven rolls of said first, second and third stands.

17. Apparatus for eliminating crescent formation in a steel strip reduction mill, comprising:

(a) first, second, third and fourth spaced apart aligned cooperating roll stands disposed in first, second and third tandem pairs with said first tandem pair comprising said first and second stands, said second tandem pair comprising said second and third stands and said third tandem pair comprising said third and fourth stands;

(b) each of said stands having first and second cooperating rolls between which a strip passes and is thereby reduced, at least one roll of a stand being driven for advancing the strip through the stand;

(c) first, second, third and fourth roll speed monitoring means, each of said roll speed monitoring means operably connected with the driven roll of a stand for monitoring the rotational speed of the associated driven roll and for transmitting data indicative thereof;

(d) first, second and third strip tension monitoring means, each of said strip tension monitoring means positioned between the stands of one of said tandem pairs and engageable with a strip for monitoring the tension of the strip extending between the stands thereof and for transmitting data indicative of the monitored tension;

(e) first, second and third speed control means, each of said speed control means operably connected with the driven roll of one of said first, second and third stands for regulating the rotational speed thereof:

(f) first, second and third tail end detection means, each of said detection means disposed upstream of one of said first, second and third tandem pairs for detecting the tail end of a strip and for transmitting data indicative thereof when the tail end is detected; and, (g) controller means in circuit connection with each of said roll speed monitoring means, said strip tension monitoring means and said tail end detection means for receiving data transmitted therefrom, said controller means including means for calculating a target interstand strip tension for a tandem pair when the associated tail end detection means detects and transmits data indicative of a tail end and for thereby causing the speed control means of the upstream stand of the associated tandem pair to increase the roll speed of the associated driven roll while monitoring the measured tension so that the interstand tension is decreased and the target interstand tension is attained.

18. The apparatus of claim 17, wherein:

(a) means being operably connected with each of said stands for driving each of the associated rolls;

(b) said roll speed monitoring means being operably connected with each roll of a stand for independently monitoring the speed thereof; and, (c) said speed control means being operably connected with each roll of said first, second and third stands for regulating the speed thereof.

19. The apparatus of claim 17, wherein:

(a) said first tandem pair tail end detection means including an infrared sensor positioned upstream of said first stand and in line with the strip.

20. The apparatus of claim 17, wherein:

(a) said second tandem pair tail end detection means being operably connected with said first stand and said third tandem pair tail end detection means being operably connected with said second stand.

21. The apparatus of claim 20, wherein:

(a) said second and third tandem pairs tail end detection means including pressure sensing means associated with said second and first stands whereby rapid changes in the pressure exerted on the rolls thereof indicates the passage of a tail end.

22. The apparatus of claim 21, wherein:

(a) said pressure sensing means including a press ductor.

23. The apparatus of claim 17, wherein:

(a) said means for calculating calculating said target interstand tension as a precentage of the monitored interstand tension of the associated tandem pair.

24. The method of eliminating crescent formation in a steel strip reduction mill having an upstream stand and a downstream stand and each of said stands having a motor driven roll, comprising the steps of:

(a) feeding a steel strip having a tail end to said mill and through said stands;

(b) monitoring the running tension of said strip when between said stands;

(c) monitoring the roll speed of at least said driven roll of said upstream stand;

(d) detecting a tail end of said strip prior to said tail end being fed through said upstream stand;

(e) calculating a target interstand strip tension below the running tension when said tail end is detected; and, (f) regulating the roll speed of the driven roll of said upstream stand as a function of the measured interstand tension so that said target interstand strip tension is attained.

25. The method of claim 24, including the steps of:

(a) providing an infrared scanner upstream of said upstream stand; and, (b) scanning said strip with said infrared sensor for detecting the tail end.

26. The method of claim 24, including the steps of:

(a) monitoring the pressure exerted by the strip when in said stands whereby rapid changes in pressure indicate passage of a tail end therethrough; and, (b) signaling passage of the tail end therethrough.

* * * * *